US005395702A

United States Patent [19]

Carey, II et al.

[11] Patent Number: 5,395,702

[45] Date of Patent: * Mar. 7, 1995

[54] COATED METAL STRIP

[75] Inventors: Jay F. Carey, II, Follansbee, W. Va.; Mehrooz Zamanzadeh, Pittsburgh, Pa.

[73] Assignee: The Louis Berkman Company, Steubenville, Ohio

[ * ] Notice: The portion of the term of this patent subsequent to May 2, 2011 has been disclaimed.

[21] Appl. No.: 229,097

[22] Filed: Apr. 18, 1994

Related U.S. Application Data

[63] Continuation of Ser. No. 101, Jan. 4, 1993, abandoned, which is a continuation-in-part of Ser. No. 858,662, Mar. 27, 1992, Pat. No. 5,314,758.

[51] Int. Cl.[6] ..... B32B 15/18

[52] U.S. Cl. ..... 428/624; 428/648; 428/685; 428/939

[58] Field of Search ..... 428/648, 685, 939, 624; 420/557, 562; 148/242

[56] References Cited

U.S. PATENT DOCUMENTS

| | | | |
|---|---|---|---|
| 84,205 | 11/1868 | Mills | 428/648 |
| 2,210,593 | 8/1940 | McCullough | 420/559 |
| 2,374,926 | 5/1945 | Fink | 117/51 |
| 2,533,048 | 12/1950 | Rodgers | 117/52 |
| 3,058,856 | 10/1962 | Miller | 148/16 |
| 3,728,114 | 4/1973 | Van Povcke | 427/432 |
| 3,860,438 | 1/1975 | Shoemaker | 427/321 |
| 4,015,950 | 4/1977 | Galland | 428/648 |
| 4,152,471 | 5/1979 | Schnedler et al. | 427/432 |
| 4,177,326 | 12/1979 | Windal et al. | 428/645 |
| 4,330,574 | 5/1982 | Pierson | 427/432 |
| 4,758,407 | 7/1988 | Ballentine et al. | 420/560 |
| 4,778,733 | 11/1988 | Lubrano et al. | 428/647 |
| 4,806,309 | 2/1989 | Tulman | 420/562 |
| 4,879,096 | 11/1989 | Naton | 420/561 |
| 4,883,723 | 11/1989 | Kilbane et al. | 427/432 |
| 4,934,120 | 6/1990 | Boyd | 52/518 |
| 4,987,716 | 1/1991 | Boyd | 52/520 |
| 5,023,113 | 6/1991 | Booton et al. | 427/432 |
| 5,202,002 | 4/1993 | Tsucninaga et al. | 204/145 R |

FOREIGN PATENT DOCUMENTS

| | | | |
|---|---|---|---|
| 746337 | 5/1933 | France . | |
| 1457769 | 10/1965 | France . | |
| 2052324 | 3/1971 | France . | |
| 2281995 | 10/1974 | France . | |
| 2713196 | 10/1978 | Germany | 420/559 |
| 42-18219 | 9/1967 | Japan | 420/558 |
| 60-208465 | 10/1985 | Japan . | |
| 1-259153 | 10/1989 | Japan | 427/432 |
| 581604 | 10/1946 | United Kingdom . | |

OTHER PUBLICATIONS

"Long Terne Sheets and Terne Plate", The Making Shaping and Treating of Steel, U.S. Steel Corp., 1957, pp. 655–659.

"Pickling of Iron an Steel", Metals Handbook, 9th ed., vol. 5, American Society for Metals, 1982, pp. 68–82.

"Hot Dip Tin Coating of Steel and Cast Iron", Metals Handbook, 9th ed., vol. 5, American Society for Metals, 1982, pp. 351–355.

Federal Specification QQ-T-201F, Nov. 1986, pp. 1–8.

R. J. Nekervis et al., "Tinning of Steel", Metals Handbook, American Society for Metals, no date, pp. 709–712.

Standard Specification for Solder Metal, American Society for Testing and Materials, B32-86, 1986, Tables, pp. 1 and 9.

Soldering Manual, American Welding Society , N.Y. 1959, pp. 21–23.

*Primary Examiner*—John Zimmerman

*Attorney, Agent, or Firm*—Vickers, Daniels & Young

[57] ABSTRACT

A weather-resistant strip roofing material having improved corrosion-resistant properties includes a strip of stainless steel which is pre-treated by an aggressive pickling process and/or a chemical activating process prior to applying a hot-dip tin coating, The pre-treatment of the stainless steel strip produces superior alloying between the stainless steel and the tin coating which reduces flaking of the tin coating.

7 Claims, 3 Drawing Sheets

COATED METAL STRIP

This application is a Continuation of U.S. patent application Ser. No. 08/000,101, filed Jan. 4, 1993, now abandoned, and which is a Continuation-In-Part Application of U.S. patent application, Ser. No. 858,662, filed Mar. 27, 1992, entitled Hot Dip Terne Coated Roofing Material, now U.S. Pat. No. 5,314,758.

The present invention relates to the art of coating a metal strip material and more particularly to the process of coating a strip of stainless steel roofing material with a hot-dipped coating of tin.

INCORPORATION BY REFERENCE

U.S. Pat. Nos. 4,987,716 and 4,934,120 illustrate metal roofing systems of the type to which this invention relates and are incorporated herein by reference. U.S. patent application Ser. No. 858,662 filed Mar. 27, 1992, illustrating a low lead coating is also incorporated herein by reference.

BACKGROUND OF THE INVENTION

For many years, roofing systems made of metal in various sheet gauge thicknesses have been used. Metals such as carbon steel, stainless steel, copper and aluminum are the most popular types of metal roofing systems. Carbon steel metal roofing systems are commonly treated with a corrosion-resistant coating to prevent rapid oxidation of the iron. One type of corrosion-resistant coating for carbon steel is a tin metal coating. Tin coating of carbon steel is a well-known process and has been used in various industries, especially in the food industry. Tin coating of carbon steel is normally carried out by a continuous, high-speed electrolysis process. In an electrolysis process, an electrical current is used to reduce alkaline or acidic electrolytes of tin to plate the tin on the carbon steel. The thickness of the tin coating ranges between $3.8\times10^{-4}$ to $20.7\times10^{-4}$ mm ($1.5\times10^{-5}$–$8.15\times10^{-5}$ in.). The equipment and materials used to electroplate carbon steel are very expensive and relatively complex to use; however, only a thin layer of tin is used so the cost of the expensive tin is maintained quite low. A less used process of coating carbon steel is by a hot dipping process. This process is normally not used because of the resulting minute areas of discontinuity in the tin coating. Consequently, the material is less satisfactory for food containers. In addition, hot dipped tin forms a thicker coating which is prone to flaking.

Tin is an important material in that it is relatively inexpensive and highly resistant to corrosion. Corrosive materials such as carbon steel can be coated with tin to produce highly corrosive-resistant and relatively inexpensive products such as tin cans and tin roofing materials. Many metallic alloys have been developed which resist corrosion, such as stainless steel. Stainless steel is an alloy of iron and chromium and sometimes includes nickel and molybdenum. The chromium within the stainless steel alloy is the primary alloy component which inhibits corrosion. The chromium forms chromium oxide and tightly bonds to the surface of the stainless steel thus preventing oxygen from penetrating into the stainless steel to form corrosive ferrous oxides. Carbon steel has little if any chromium content, thus the iron readily oxidizes with the surrounding oxygen to form ferrous oxides commonly known as corrosion.

Although stainless steel corrodes at a significantly slower rate than standard carbon steel, the stainless steel will eventually corrode and will corrode at a significantly faster rate than carbon steel coated with tin plate. Previously, the concept of coating stainless steel with a corrosive-resistant material was unheard of since stainless steel in and of itself is a corrosive-resistant material. Furthermore, attempts to coat stainless steel have proven of limited success. Specifically, coating stainless steel with tin by a hot-dip process has repeatedly been unsuccessful using conventional hot-dip processes. The tin coating repeatedly flakes off the stainless steel soon after being coated and/or during pre-forming and installation. Until now, industrial manufacturing of hot-dipped tin coated stainless steel has been unsuccessful. Presently, the only process which semi-successfully coats stainless steel with tin is the electroplating process. The electroplating of stainless steel involves the use of very expensive and relatively complex machinery. The electroplating of tin onto stainless steel results from running a stainless steel strip through a stanneous solution. An electrical current is introduced to the stanneous solution and the tin is reduced and plated onto the stainless steel strip. The thickness of the tin plate is limited to a thickness not more than $20.7\times10^{-4}$ mm ($8.15\times10^{-5}$ in.). The limited tin coating thickness resulting from electroplating limits the uses and life of the tin plated materials. Although tin is a highly corrosion-resistant material, tin will slowly corrode in harsh environments such as salt water or acid environments. Thicker tin coatings in such environments would vastly increase the useable life of the tin coated materials.

Coating stainless steel with tin alloys by a hot-dipped process have been more successful. One of the most popular tin alloy coatings for carbon steel and stainless steel is a tin-lead alloy commonly known as terne. The composition of the terne alloy is generally about 80 weight percent lead and about 20 weight percent tin. The lead in the terne alloy readily bonds to both carbon steel and stainless steel to form a strong and durable tin alloy coating. Although terne coated sheet metals have excellent corrosive-resistant properties and have been used in a wide variety of building applications such as roofing, terne coated materials have recently raised environmental concerns due to the lead content of the terne alloy. Although the lead in the terne alloy is stabilized, there is some concern, albeit unfounded, about leaching of the lead from the terne alloy. As a result, terne coated materials have been limited from use in various applications, such as aquifer roofing systems. Terne alloys are also a softer material than tin, thus, wear faster than tin coatings and are not as strong as tin coatings. Due to the expensive nature of electroplating stainless steel materials and the limitations as to the thickness of the stainless steel materials, there has been a demand for a process for successfully hot dipping stainless steel materials with tin.

SUMMARY OF THE INVENTION

The present invention relates to the process of manufacturing a weather-resistant strip roofing material comprising a strip of stainless steel having a hot-dipped coating of tin. Although the tin coated stainless steel is primarily used for roofing materials, the tin coated stainless steel can be used in a variety of applications requiring highly corrosive-resistant materials.

In accordance with the principal feature of the present invention, there is provided a strip of stainless steel having a tin coating formed by hot dipping the stainless steel into molten tin, thereby forming a bonded tin coating with a desired thickness. A strip of stainless steel is specially treated to form a strong and durable bond between the hot-dipped tin and the stainless steel strip, which resists flaking of the tin off of the stainless steel. The type of stainless steel used is generally 304 or 316 stainless; however, other types of stainless steel may be used. The thickness of the stainless steel is generally not more than 0.2 in. thick and is typically 0.05 in. thick. The pre-treatment of the stainless steel includes aggressive pickling and chemical activation of the stainless steel prior to the hot dipping of the stainless steel into the molten tin. The aggressive pickling process is designed to remove a very thin surface layer from the stainless steel. The removal of a very thin layer from the surface of the stainless steel is necessary before proper bonding of the hot-dipped tin on the stainless steel can be achieved. Stainless steel contains primarily chromium and iron. The chromium on the stainless steel surface reacts with atmospheric oxygen to form chromium oxide. The chromium oxide film creates an almost impenetrable barrier between the iron within the stainless steel and the oxygen in the atmosphere, thus inhibiting the oxygen to combine with the iron to form iron oxides. The chromium oxide film also forms a very tight and strong bond with the stainless steel and is not easily removed. Although the formation of the chromium oxide film is important in the corrosion-resistant properties of the stainless steel, the chromium oxide film interferes with the bonding of a thin layer of hot-dipped tin to the stainless steel surface resulting in weak tin bonding and flaking. The aggressive pickling process removes the chromium oxide from the stainless steel surface to allow the hot-dipped tin to properly bond with the stainless steel. The aggressive pickling process also may slightly etch the stainless steel to remove a very thin layer of the stainless steel surface. Because the rate of etching is not the same throughout the surface of the stainless steel, microscopic valleys are formed on the stainless steel which significantly increase the surface area for which the hot-dipped tin can bond to the stainless steel. The increased bonding surface formed from etching further strengthens the bond between the tin and stainless steel. Pickling processes which are used to treat carbon steel or stainless steel for tin electroplating do not properly and adequately treat the stainless steel surface to both remove chromium oxide and partially etch the stainless steel surface to form a quality hot-dip tin coated material. The aggressive pickling process includes the use of a pickling solution which attacks, removes and/or loosens chromium oxide from the stainless steel surface. The pickling solution contains various acids or combinations of acids such as hydrofluoric acid, sulfuric acid, nitric acid, hydrochloric acid, phosphoric acid and/or isobromic acid. Generally, hydrochloric acid in combination with nitric acid are used as the pickling solution to remove the chromium oxide from the stainless steel. A relatively high concentration of acid is used in the pickling solution. In a hydrochloric-nitric acid pickling solution, the pickling solution contains about 5–25% hydrochloric acid and 1–15% nitric acid. The unpredictable success of combining hydrochloric acid and nitric acid results in superior and rapid removal of chromium oxide from the stainless steel. The dual acid also causes limited etching of the stainless steel to increase the surface area without causing detrimental pitting of the stainless steel surface. The temperature of the pickling solution is important so as to provide a highly active acid which will readily remove the chromium oxide from the stainless steel surface. The temperature of the pickling solution is generally above 80° F. and typically ranges between 120° to 140° F. The pickling solution should be agitated during the aggressive pickling process to prevent the pickling solution from stagnating and varying concentration. During the aggressive pickling process, the concentration of the nitric acid and hydrochloric acid fluctuates. Furthermore, as the acid reacts with the stainless steel, the temperature of the pickling solution increases. If the acid concentration and temperature are not kept constant, proper chromium oxide removal and etching may not occur. Agitating the pickling solution also disperses gas pockets which may form on the stainless steel surface. These gas pockets prevent the pickling solution from removing chromium oxide from the stainless steel surface. Agitation of the pickling solution may be carried out by placing agitators in the pickling vat and/or recirculating the pickling solution. Agitation brushes may also be used within the pickling vat to agitate the acid solution and scrub the stainless steel surface within the acid solution. Scrubbing the stainless steel surface increases and accelerates the removal of chromium oxide from the stainless steel surface. The temperature of the pickling solution may be maintained by recirculation through heat exchangers. Typically, one pickling vat which contains the pickling solution is needed to treat the stainless steel; however, multiple pickling vats in series may be used. The pickling vats are generally twenty-five feet in length; however, the size of the vat may be longer or shorter. The amount of time the stainless steel is treated in the pickling solution is important to adequately remove the chromium oxide without damaging the stainless steel so as not to create pitting or remove too much of the stainless steel strip. Generally, the pickling process lasts less than a minute and typically is between 10 to 20 seconds. In an aggressive pickling process having pickling vats approximately twenty-five feet in length, the stainless steel strip is run through the pickling vats at speeds generally less than about 150 ft./min. and typically between 50–115 ft./min.

The stainless steel strip, after aggressive pickling, is further treated by chemically activating the surface of the stainless steel to enhance the bonding of the tin to the stainless steel. After the aggressive pickling process, very little oxide is present on the stainless steel surface. The virgin surface is highly susceptible to forming oxides between the time period the stainless steel strip leaves the pickling vat and being hot-dip tin coated. Furthermore, some remaining chromium oxide may be present on the stainless steel strip after aggressive pickling. The chemical activation of the stainless steel includes the chemical treatment of the stainless steel with a deoxidizing agent to remove any residual oxides which remain on the stainless steel surface after the aggressive pickling process. Various deoxidizing solutions may be used such as zinc chloride. It has also been found that the treating of the stainless steel strip with zinc chloride, prior to the coating of the stainless steel with the molten tin, provides a protective coating to the stainless steel strip which prevents oxides from forming on the stainless steel strip. The zinc chloride acts as both a deoxidizer and a protective coating for the stainless steel strip. The temperature of the zinc chloride solution is generally kept at ambient temperature (60°–90° F.)

and agitated to maintain a uniform solution concentration. Small amounts of hydrochloric acid may also be added to the deoxidizing solution to further enhance oxide removal.

In accordance with another embodiment of the present invention, the stainless steel is treated with an abrasive and/or absorbent material prior to being aggressively pickled. Strips of stainless steel that are unrolled from stainless steel rolls commonly have foreign debris on the surface of the stainless steel strip. Such debris may consist of dirt, oil, glue, etc. Many of these foreign substances do not react with or are not readily removable by the pickling solution, thus adversely affecting the removal of chromium oxide from the stainless steel. Treating the stainless steel strip with an abrasive and/or absorbent material removes the foreign substances from the stainless steel strip. The abrasive material also may initially remove some of the oxides which have formed on the stainless steel, thus enhancing the aggressive pickling process. The abrasive material may be one or more steel brushes positioned about the surface of the stainless steel. The brushes may be stationary or moving relative to the stainless steel. The brushes roughen the surface of the stainless steel to further enhance the etching of the stainless steel during the pickling process. The roughed up surface of the stainless steel allows the acid solution to more readily attack the surface of the stainless steel.

In accordance with yet another aspect of the present invention, the aggressive pickling process includes the maintaining of a low oxygen environment prior to and/or subsequent to subjecting the stainless steel strip to the pickling solution. The maintenance of a low oxygen environment for the stainless steel strip is important so as to inhibit the formation of oxides on the stainless steel surface. The low oxygen environment may take on several forms. The two most common low oxygen environments are the formation of a low oxygen-containing gas environment about the stainless steel strip or the immersion of the stainless steel strip in a low oxygen-containing liquid environment. Both these environments act as shields against atmospheric oxygen and prevent oxides of iron and chromium from forming. If the stainless steel strip is treated with an abrasive and/or absorbable material as the strip is unrolled, a low oxygen environment generally is maintained about the strip until the stainless steel strip enters the pickling solution. During abrasion and/or absorption treating of the stainless steel, some of the oxides are removed from the stainless steel surface. The non-oxidized surface is highly susceptible to oxidation when in contact with oxygen. By creating a low oxygen environment about the stainless steel strip, new oxide formation is prevented. By lowering and maintaining the amount of oxides on the stainless steel surface prior to the stainless steel entering the pickling solution, a more efficient oxide removal and surface etching will result. If a low oxygen gas environment is used, the gasses used to form the low oxygen-containing environment are typically nitrogen, hydrocarbons, hydrogen, noble gasses and/or other non-oxygen containing gasses. Generally, nitrogen gas is used to form the low oxygen gas environment. Although a low oxygen gas environment is generally formed between the abrasion/absorption process and pickling process, a low oxygen liquid environment may be used. A low oxygen environment is also generally formed between the pickling solution vat and the pickling rinse vat. After the stainless steel strip exits the pickling solution, most, if not all, of the oxides are removed from the stainless steel surface. The low oxide content on the stainless steel surface makes the surface readily susceptible to oxide formation. A low oxygen environment is typically installed to prevent the deleterious effects of oxide formation subsequent to the emergence of the stainless steel strip from the pickling solution. Either a low oxygen gas or liquid environment may be used to prevent the oxide formation. Typically, a low oxygen gas environment of nitrogen is used to inhibit chromium oxide and iron oxides from reforming on the stainless steel surface after the stainless steel exits the pickling solution. A low oxygen environment is also generally formed prior to the chemical activation process. A low oxygen liquid environment is typically used at this stage of stainless steel treatment. The low oxygen liquid environment normally consists of heated water sprayed on the surfaces of the stainless steel; however, the stainless steel may also be immersed in the water. Heated water contains very low levels of dissolved oxygen thus, by maintaining the water at a proper temperature, the heated water acts as a shield against oxygen from forming oxides with the stainless steel. The spray action of the heated water also removes any remaining pickling solution from the stainless steel prior to the stainless steel etching the chemical activation process. Generally, the temperature of the heated water is maintained above 100° F. and typically about 110° F. or greater so as to exclude the unwanted dissolved oxygen. Although not necessary, a low oxygen environment may be formed after the stainless steel strip exits from the chemical activation process and prior to entering the molten tin. Generally, this low oxygen environment is a gas environment.

In accordance with still yet another aspect of the present invention, the stainless steel strip is rinsed with heated water after exiting the pickling solution to remove the pickling solution from the stainless steel. After the stainless steel exits the pickling solution, some pickling solution may remain on the stainless steel which may continue to eat through the stainless steel resulting in possible pitting of the stainless steel. The pickling solution is removed from the stainless steel strip by passing the stainless steel through a heated body of water. The water should typically be above 100° F. and generally be about 110° F. so as to exclude the dissolved oxygen from the water to prevent oxidation of the post-pickled stainless steel strip. The rinse solution is generally maintained at its desired temperature by recirculating the rinse solution through heat exchangers. Although the rinse process primarily removes the pickling solution from the stainless steel, the rinse process also may remove loosened chromium oxide and other oxides from the stainless steel surface. The rinse solution removes small amounts of oxides due to the slightly acidic nature of the rinse solution. As the rinse solution removes the pickling solution from the stainless steel strip, the pickling solution enters the rinse solution and acidifies the rinse solution. The slightly acidic rinse solution attacks small amounts of oxides on the stainless steel to further clean the stainless steel surface. The rinse solution generally is agitated to both facilitate the removal of the pickling solution from the stainless steel and to dilute the removed pickling solution within the rinse solution. The agitators may include moving brushes which may or may not contact the stainless steel strip. The rinse solution is generally recirculated and diluted to maintain a low acidity.

In accordance with another aspect of the present invention, there is provided a tinning vat. The tinning vat generally includes a flux box whereby the stainless steel strip passes through the flux box and into the molten tin. The flux box typically contains a flux which has a lower specific gravity than the molten tin, thus the flux floats on the surface of the molten tin. The flux within the flux box acts as the final surface treatment of the stainless steel. The flux removes any residual oxides from the stainless steel surface and shields the stainless steel surface from oxygen until the stainless steel is hot-dip tin coated. The flux normally consists of zinc chloride and ammonium chloride. Typically, the flux solution contains approximately 30–60 weight percent zinc chloride and about 5–40 weight percent ammonium chloride; however, the concentrations of the two flux agents may be varied accordingly. Once the stainless steel strip passes through the flux, the stainless steel strip enters into the molten tin. The temperature of the molten tin typically ranges between 575°–650° F. at the bottom of the tinning vat and may be over 100° cooler at the top of the tinning vat. The tin must be maintained above its melting point of 449° F. or improper coating will occur. Typically, the tin is maintained at a temperature of 590° F. The tin used to coat the stainless steel contains little if any lead. Generally, the lead content is not greater than 0.02 weight percent. The tin may contain bismuth or antimony alloys. Both bismuth or antimony are elements which add to the abrasive resistant properties of the tin coating and prevent the tin from crystallizing during cooling, which may result in the flaking of the tin from the stainless steel. Tin begins to crystallize when the temperature drops below 56° F. (13.2° C.). Only a small amount of antimony or bismuth is needed to prevent the tin from crystallizing. Typically, amounts of less than 0.5 weight percent are required to adequately inhibit the crystallization of the tin, which may result in the tin coating prematurely flaking off of the stainless steel strip material.

Amounts greater than 0.5 weight percent may be used to harden the tin coating. The hardening effects of antimony and bismuth in the tin may adversely affect the pre-forming of the tin-coated materials for use in various applications. Therefore, the amount of antimony and bismuth added to the tin is a factor in the particular application the tin-coated material is used in. The bismuth may be in the range of 0.0–1.7 weight percent of the tin coating and the antimony may be in the range of 0.0–7.5 weight percent of the tin coating. Other metal alloys such as zinc, titanium and nickel may be added in small amounts to tin to further strengthen the tin coating. The thickness of the coating of the tin is controlled by the speed at which the stainless steel strip travels through the molten tin, the amount of time the stainless steel strip is in contact with the molten tin and the spacing between the coating rollers. As the speed of the metal strip passing through the molten tin increases, shear forces within the molten tin reduce the thickness of the coating formed on the stainless steel layer. The time at which the stainless steel strip is in the molten tin is also a factor in determining the amount of tin coated on the stainless strip. The longer the time the stainless steel strip is in contact with the molten tin, the thicker the potential tin coating. The speed at which the stainless steel strip travels in the molten tin also affects the alloying of the tin to the stainless steel. A too high of strip speed will create high shear forces resulting in improper and defective alloying of the tin to the stainless steel. The speed of the stainless steel strip should be maintained below 150 ft./min. and typically ranges between 50 to 115 ft./min. As the stainless steel tin coated strip leaves the molten tin, the strip generally passes between one or more sets of coating rollers which maintain a uniform thickness of the tin coating. The coating rollers also form a smooth and uniform tin coating on the metal strip when the metal strip passes between the coating rollers. Palm oil is typically present on the surface of the molten tin and may partially surround the coating rollers. The palm oil acts as an agent to aid in obtaining good distribution of the tin and also serves as a coolant for the tin coating. The palm oil also prevents the top of the molten tin from solidifying and/or oxidizing. The temperature of the palm oil at the top of the molten tin is normally maintained as low as possible by recirculating the palm oil through heat exchangers. The temperature of the palm oil is typically between 460°–470° F. At higher temperatures, the palm oil readily polymizes which may cause yellow streaks on the tin coating. The tin coating produced from the hot-dip process is significantly thicker than thicknesses achieved by an electroplating process. Generally, the tin coating has a thickness ranging between 0.0003–0.05 in.; however, thicker coatings are obtainable. Typically, the tin coating thickness is maintained between 0.001 to 0.002 in. The greater thicknesses of the tin coating achieved by the hot-dip process increase the useable life of the tin coated materials significantly beyond comparable plated materials coated by electroplating.

In accordance with still yet another aspect of the present invention, metal sprayer jets are positioned adjacent to the coating rollers to ensure complete tin coating of the stainless steel. The metal sprayers spray molten tin onto the coating rollers. As the coating rollers rotate to allow the stainless steel strip to pass between the coating rollers, the molten tin sprayed on the rollers is pressed against the stainless steel strip and fills in any pin holes or uncoated surfaces on the stainless steel. Consequently, two separate tinning steps are not required.

In accordance with yet another feature of the present invention, there is provided a tin cooling process whereby the newly tin coated stainless steel strip is cooled. The tin-cooling process generally consists of a liquid cooling process. The liquid cooling process normally uses water as the cooling fluid; however, other fluids may be used. The tin coating may be cooled at different rates to achieve different grain size and grain densities. Slowly cooling the tin coating results in larger grain size, lower grain densities, and a highly reflective surface. Rapid cooling of the tin coating produces fine grain size, increased grain density and a less reflective surface. Small grain sizes and higher grain densities produce a stronger bond with the stainless steel and greater corrosion resistance. The liquid cooling of the tin coating can be accomplished by injecting cooled liquid onto the coated tin or immersing the coated stainless steel strip in a cooled liquid vessel. In a liquid injection process, water is generally jet sprayed onto tin coating. The coated strip is generally guided through the cool water jet sprays by a camel-back guide. The camel-back guide is designed such that only the edges of the coated strip contact the guide. By minimizing the contact of the coated strip with the guides, the amount of tin inadvertently removed from the coated strip is reduced. The camel-back guide is also designed to allow the water jets to cool the underside of the coated strip.

The temperature of the cooling water is generally less than or equal to ambient temperature. The tin coating may also be cooled by submerging the coated strip in cooling water. The water is generally not warmer than ambient temperature. The cooling water is normally agitated to increase the cooling rate of the tin. Generally, the temperature of the cooling water is maintained at proper cooling temperatures by recycling the water through heat exchangers and/or replenishing the water. The cooling water is generally not deoxygenated prior to cooling the tin coating. The oxygen in the cooling water oxidizes with the tin during rapid cooling which results in a slightly discolored tin surface having reduced reflectability. The reduction of the highly reflective surface of the tin-coated stainless steel strips allows the strips to be used in various applications such as roofing in civilian and military airports which require non-reflective building materials.

In accordance with another aspect of the present invention, the coated stainless steel strip is passed through a leveler, whereby the coated tin is uniformly molded about the stainless steel strip. Generally, the leveler consists of a plurality of rollers. The coated strip is passed through the rollers at a tension to smooth out the tin coating on the steel strip.

In accordance with another aspect of the present invention, the coated stainless steel is sheared after it has been rolled or leveled. The shearing device normally travels next to and at the same speed as the coating strip to properly shear the moving strip.

In accordance with another aspect of the present invention, the coated steel material is treated with a weathering agent to accelerate the weathering and discoloration of the coated tin. The weathering material is typically an asphalt-based paint which causes accelerated weathering of the coated tin when it is exposed to the atmosphere. The asphalt-based paint significantly decreases the weathering time of the coated tin to less than a year. Typically, the asphalt paint is a petroleum-based paint comprised of asphalt, titanium oxide, inert silicates and low-clay carbon black or other free carbon and an anti-settling agent. The asphalt-based paint is generally applied at a relatively thin thickness so as to form a semi-transparent or translucent layer over the tin coating. Generally, the thickness of the asphalt-based paint ranges between 0.25 to 5 mils and typically is 1–2 mils. Once the translucent paint has been applied to the stainless steel tin coated material, the material is air dried and/or heated by heating lamps.

The primary object of the present invention is the provision of a weather-resistant stainless steel roofing material coated with a thin layer of hot-dipped tin.

Another object of the present invention is the provision of aggressively pickling a stainless steel strip prior to hot dipping the stainless steel with tin to form a strong alloy bond between the tin and stainless steel.

Yet another object of the present invention is the provision of chemically activating the stainless steel subsequent to aggressive pickling to enhance the bonding between the stainless steel and tin coating.

Still yet another object of the present invention is the provision of reducing the oxygen interaction with the stainless steel during the pre-treatment of the stainless steel prior to hot-dip coating the stainless steel with tin.

Another object of the present invention is a tin coating containing very low amounts of lead, preferably no lead, and containing antimony and/or bismuth to harden and strengthen the tin coating and to inhibit crystallization of the tin.

Yet still another object of the present invention is the provision of rapidly cooling the hot-dipped coated tin to form fine, high density grains which produce a stronger bonding, more corrosive-resistant, discolored tin coating.

Another object of the present invention is the provision of abrasively treating the stainless steel surface prior to aggressive pickling.

Still yet another object of the present invention is the provision of tin metal spray jets which spray tin metal onto the coating rollers to eliminate non-tin coated surfaces on the stainless steel.

Another object of the present invention is the provision of coating the hot-dipped tin coated stainless steel with a weathering material to accelerate the dulling of the surface of the tin coating.

Another object of the present invention is the provision of a tin coated stainless steel strip which allows the strip to be soldered with tin solder, thus negating the need for solder with lead.

Still a further object of the present invention is the provision of a coated strip, as defined above, which strip does not require intentional oxidation to prevent a shiny surface.

These and other objects and advantages will become apparent to those skilled in the art upon reading the following description taken together with the accompanying drawings.

DESCRIPTION OF TEE PREFERRED EMBODIMENT

Figure 1:
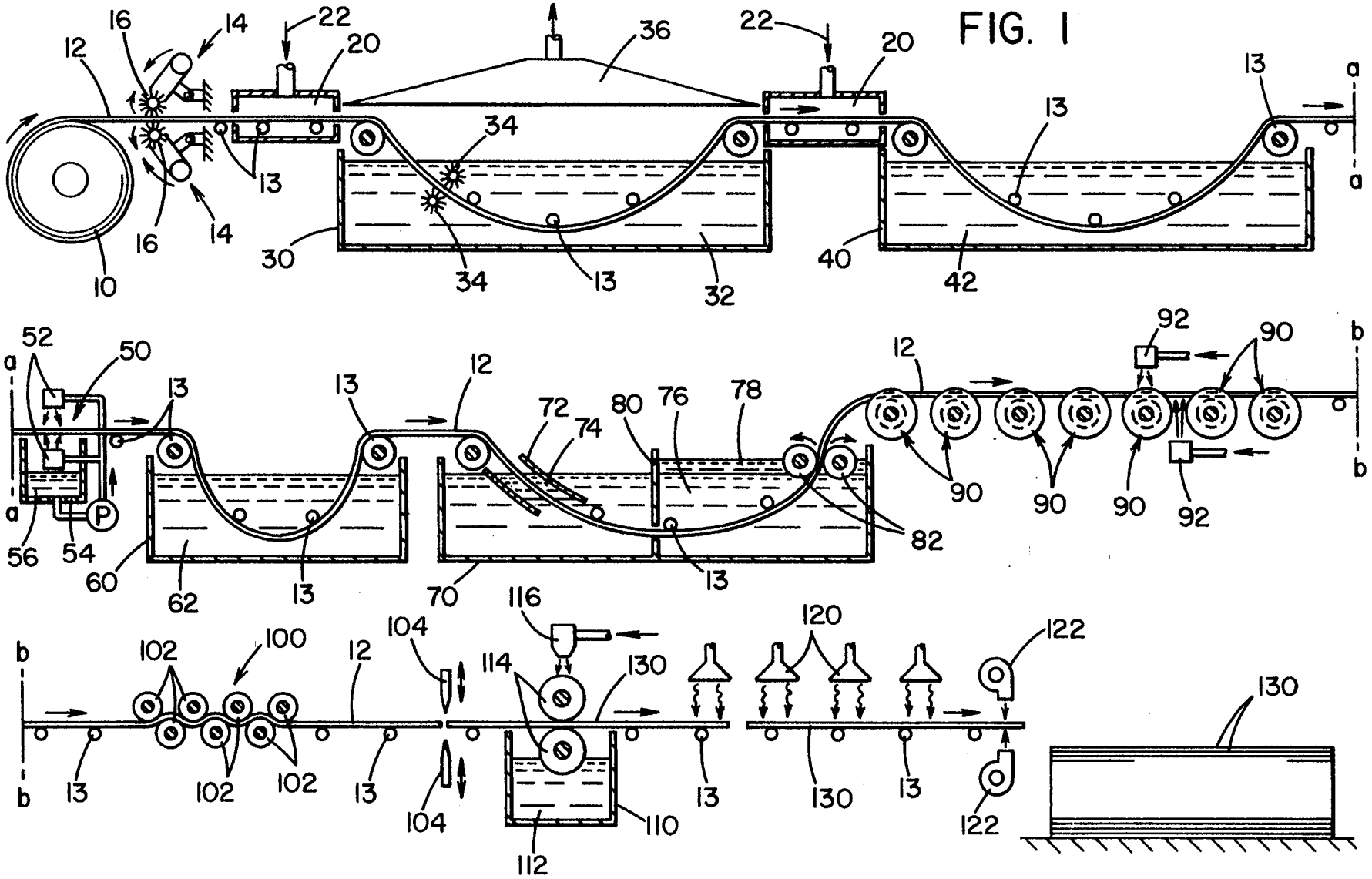
FIG. 1 is a cross-sectional view of the complete hot-dip tin coated stainless steel process of the present invention.

Referring now to the drawings, wherein the showings are for the purpose of illustrating preferred embodiments of the invention only and not for the purpose of limiting the same, reference is first had to FIG. 1 which is noted above, illustrates the complete novel process for hot-dip coating tin on stainless steel sheets. Stainless steel strip 12 typically enters the hot-dip tin coating process from large stainless steel roll 10. Generally, the stainless steel used is 304 type stainless steel, which contains about 18 percent chromium and about 8 percent nickel. The thickness of stainless steel strip 12 is about 0.015 in. thick; however, stainless steel strip 12 may be thicker and have a thickness up to about 0.2 in. Stainless steel strip 12 is generally unwound from stainless steel roll 10 at speeds which are generally less than 150 ft./min. and preferably between 70 to 100 ft./min. Strip guides 13 are positioned throughout the hot-dip tin coating process to properly guide stainless steel strip 12 through each treatment process.

Abrasion treater 14, in the form of wire brushes 16, is driven by motors. The wire brushes are placed in contact with stainless steel strip 12 to remove foreign objects from stainless steel strip 12 and to initially etch and/or mechanically remove chromium oxide from the surface of stainless steel strip 12. Abrasion treater 14 may take any form but is preferably biased against stainless steel strip 12 to provide the necessary friction between the brushes 16 and stainless steel strip 12 for proper cleaning of stainless steel strip 12. Typically, there is an abrasion treater 14 located on the top and bottom surface of stainless steel strip 12 so that proper treatment of stainless steel strip 12 is achieved. Abrasion brush 16 is typically made of a metallic material having a hardness greater than stainless steel strip 12 so that abrasion brush 16 will not quickly wear down and can properly remove foreign materials and/or pre-etch stainless steel strip 12. Generally, abrasion brush 16 rotates in an opposite direction relative to the moving stainless steel strip 12 to provide additional abrasion to the stainless steel strip 12.

Once stainless steel strip 12 passes through abrasion treater 14, then begins the aggressive pickling process. Stainless steel strip 12 enters low oxygen gas environment 20. Low oxygen gas environment 20 is formed by surrounding the stainless steel strip 12 with low oxygen-containing gas 22. Preferably, the low oxygen-containing gas 22 is composed essentially of nitrogen gas. The nitrogen gas surrounding the stainless steel strip 12 acts as a barrier against oxygen in the atmosphere and prevents the oxygen from reacting with chromium and iron on stainless steel strip 12 recently exposed by abrasion treater 14.

Stainless steel strip 12 after leaving low oxygen gas environment 20 enters into pickling vat or tank 30. Pickling tank 30 is generally about 25 feet in length and of sufficient depth to completely immerse stainless steel strip 12 in pickling solution 32. Pickling solution 32 preferably consists of a hydrochloric acid-nitric acid solution. Typically, the hydrochloric-nitric acid concentration within pickling solution 32 is about 10% hydrochloric acid and 3% nitric acid. Pickling solution 32 is generally maintained at a temperature between 128°–133° F. so that pickling solution 32 is maintained in a high reactive state for proper removal of chromium oxide from the surface of stainless steel strip 12. Pickling solution 32 also provides minor etching of the surface of stainless steel strip 12, which removes a very small surface layer of stainless steel strip 12. Pickling tank 30 preferably contains at least one agitator 34. Agitator 34 is provided to agitate pickling solution 32 to maintain a uniform solution concentration, maintain a uniform solution temperature and break up any gas pockets which may form on stainless steel strip 12. Agitators 34 generally are comprised of an abrasive material which both agitates the pickling solution 32 and facilitates the removal of chromium oxide from stainless steel strip 12. Generally, agitators 34 are made of a material which does not react with pickling solution 32. A pickling solution vent 36 is preferably placed above pickling vat 30 to collect and remove acid fumes and other gasses escaping from pickling vat 30. Stainless steel strip 12 immediately enters low oxygen gas environment 20 after exiting pickling vat 30. After stainless steel strip 12 exits pickling vat 30, stainless steel strip 12 is essentially deficient of any chromium oxide and is highly susceptible to oxidation with oxygen in the atmosphere. Low oxygen gas environment 20 shields the surface of stainless steel strip 12 from atmospheric oxygen and prevents any oxides from forming.

Pickling solution 32 is primarily removed from stainless steel strip 12 in rinse tank 40. Rinse tank 40 contains a rinse solution 42 which is preferably water. The water in rinse tank 40 is deoxygenated by heating the water to above 100° and preferably about 110° F. Due to the slightly acidic properties of rinse solution 42, rinse solution 42 removes small amounts of oxides which may still exist on the surface of stainless steel strip 12. Rinse tank 40 is generally about 20 feet in length but may be longer depending on the rate of speed at which stainless steel strip 12 is traveling. Rinse solution 42 is typically agitated so as to facilitate the removal of pickling solution 32 from stainless steel strip 12 and to enhance removal of small amounts of oxides. After stainless steel strip 12 leaves rinse tank 40, stainless steel strip 12 enters low oxygen liquid environment 50. Low oxygen liquid environment 50 consists of at least two spray jets 52, one located on each side of stainless steel strip 12. Spray jets 52 inject a low oxygen-containing liquid 56 from reservoir 54 on the surface of stainless steel strip 12 to prevent oxygen from reacting with the chromium and/or iron on the surface of stainless steel strip 12. Spray jets 52 also remove any additional pickling solution 32 which may have been left on stainless steel strip 12 after exiting rinse tank 40. Low oxygen-containing liquid 56 generally consists of heated water having a temperature of about 110° F. Low oxygen liquid environment 50 is the last stage in the aggressive pickling process of stainless steel strip 12.

Stainless steel strip 12 upon leaving low oxygen liquid environment 50 enters chemical activating tank 60. Chemical activating tank 60 contains a chemical activating solution 62, which further removes any oxides remaining on the surface of stainless steel strip 12. Preferably, chemical activating solution 62 is a zinc chloride solution maintained at a temperature between 80°–90° F. The zinc chloride within chemical activating vat 60 not only removes lingering oxides on stainless steel strip 12, but the zinc chloride acts as a protective temporary coating which prevents oxide formation on stainless steel strip 12 until stainless steel strip 12 enters tinning tank 70.

Prior to stainless steel strip 12 being coated in molten tin 76, stainless steel strip 12 enters flux box 72 located in tinning tank 70. Flux box 72 contains a flux 74 having a specific gravity less than that of molten tin 76. Flux 74 preferably consists of a zinc chloride and ammonia chloride solution. Preferably, flux 74 contains about 50% zinc chloride and about 8% ammonia chloride. Flux 74 is the final pre-treating process of stainless steel strip 12 for removal of any remaining oxides on the surface of stainless steel strip 12. Upon leaving flux box 72, stainless steel strip 12 enters molten tin 76. Molten tin 76 in tinning tank 70 is maintained at a temperature above 449° F. and preferably at a temperature of about 590° F. Tinning tank 70 is preferably divided into two chambers by palm oil barrier 80 so as to prevent palm oil 78 from spreading over the total surface of molten tin 76 in tinning tank 70. Molten tin 76 has a lead content which is less than or equal to about 0.02 weight percent. Molten tin 76 preferably contains about 0.5 weight percent of antimony and/or bismuth so as to inhibit the crystallization of the tin coating when cooled. Molten tin 76 may contain additional amounts of antimony, bismuth or other metals; however, the tin content of molten tin 76 is preferably about 99 weight percent. Prior to exiting the tinning vat 70, the stainless steel strip 12 passes between at least one set of coating rollers 82. Coating rollers 82 maintain the desired tin coating thickness on stainless steel strip 12 and remove any excess tin from stainless steel strip 12. The thickness of the tin coating on stainless steel strip 12 is generally maintained between 0.003 to 0.05 in. and is preferably between 0.01 to 0.02 in. Palm oil 78 is preferably located near coating rollers 82. Palm oil floats on top of molten tin 76 to prevent the tin from solidifying and oxidizing and also aids in properly distributing the tin on stainless steel strip 12.

Figure 2:
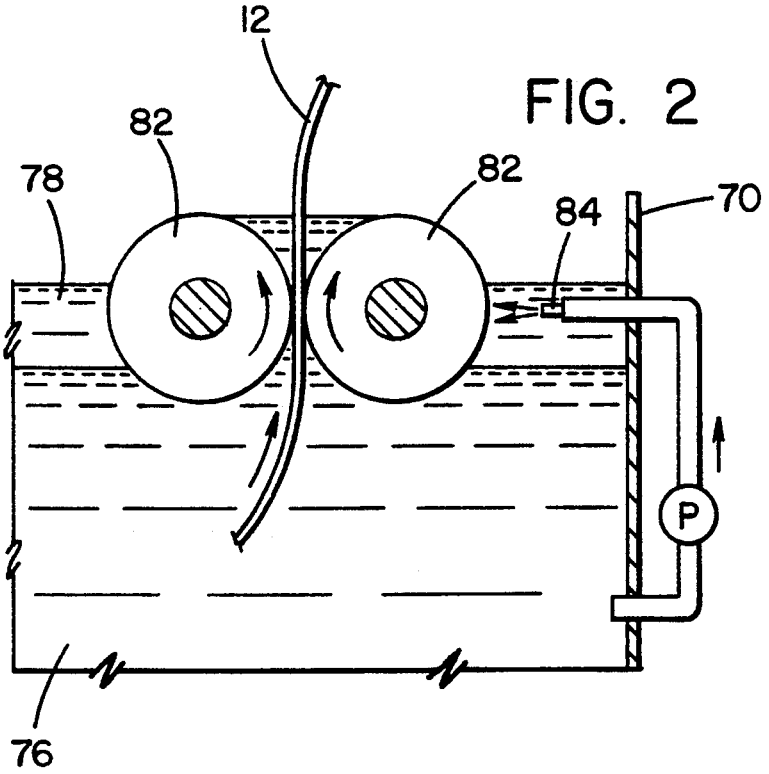
FIG. 2 illustrates a cross-sectional view of an alternative embodiment wherein metal spray jets are used during the hot-dip tin coating of the stainless steel strip.

In an alternative embodiment, FIG. 2 illustrates a metal coating jet 84 which injects molten tin on the outer surface of coating roller 82. Molten tin 76 which is spray jet on coating roller 82 is pressed against stainless steel strip 12 as stainless steel strip 12 travels between coating roller 82 to fill in any small surface areas on stainless steel strip 12 which have not been coated by the tin in tinning tank 70.

Figure 1A:
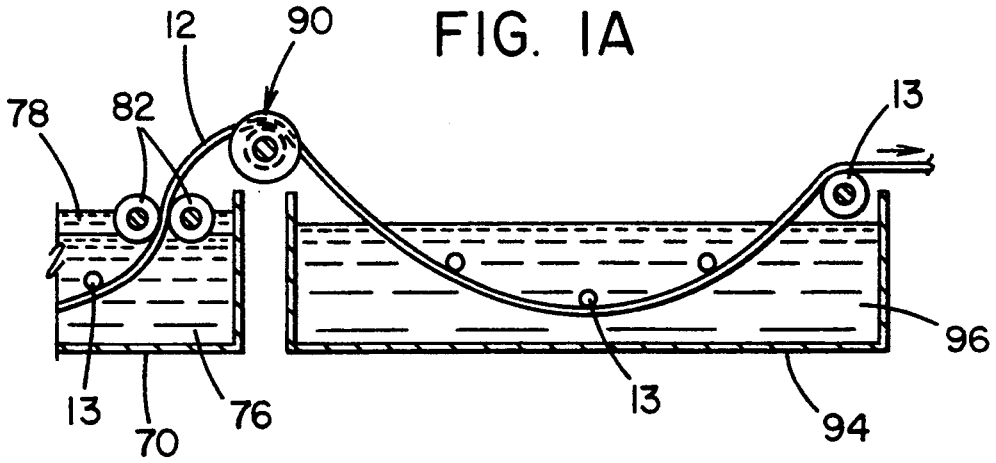
FIG. 1A illustrates a cross-sectional view of an alternative process of cooling the hot-dip tin coated stainless steel of the present invention.
Figure 3:
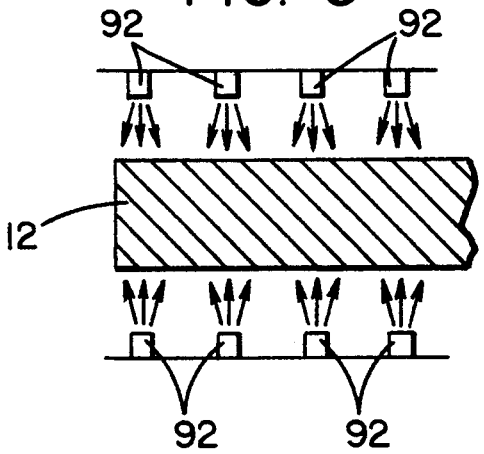
FIG. 3 is a schematic side view illustrating preferred embodiment for cooling the hot-dip tin coated stainless steel by using cool water spray jets.
Figure 4:
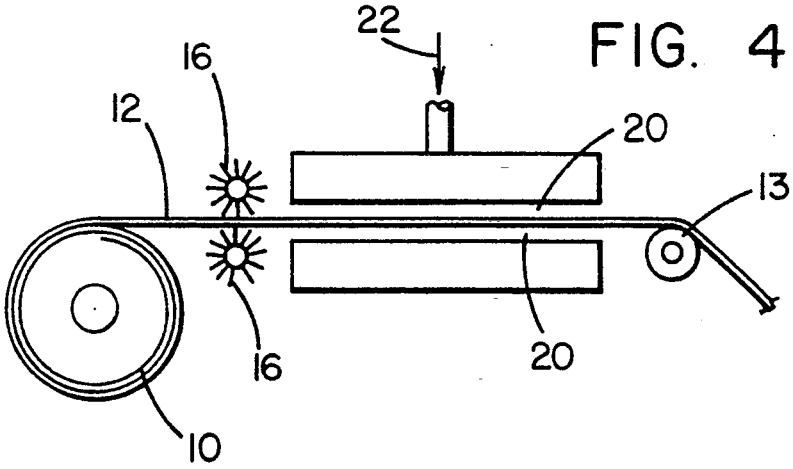
FIG. 4 illustrates a cross-sectional view of an alternative embodiment wherein abrasion treaters are used in conjunction with a low oxygen environment for pretreatment of the stainless steel strip prior to pickling; and, FIG. 5 is a frontal view of a camel-back guide.
Figure 5:
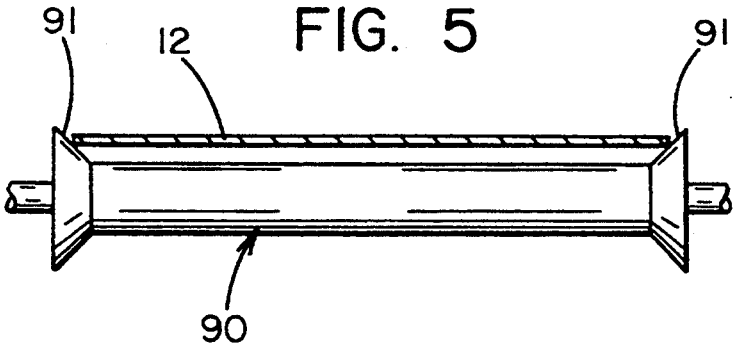

After stainless steel strip 12 exits tinning tank 70, the tin coating is rapidly cooled by at least one cool water jet sprayer 92. As the stainless steel strip 12 moves under the cool water spray jet 92 as illustrated in FIG. 3, stainless steel strip 12 is guided by camel-back guides 90 as illustrated in FIG. 5. Camel-back guide 90 is designed such that it has two receding edges 91, formed by conical surfaces, which contact only the edges of stainless steel strip 12 to minimize the removal of the tin coating from stainless steel strip 12. In an alternative embodiment as illustrated in FIG. 1A, stainless steel strip 12 is rapidly cooled in a cooling tank 94 wherein stainless steel strip 12 is immersed in cooling water 96. Cooling water 96 is generally maintained at ambient temperatures and is preferably agitated to increase the rate of cooling of the tin coating. Rapid cooling of the tin coating by either cooling tank 94 or cool water jet spray 92 is achieved so as to produce a tin coating having fine grain size with increased grain density. Also, rapid cooling of the tin coating results in oxidation of the tin coating surface to produce a gray less-reflective surface.

Stainless steel strip 12 after being rapidly cooled is subjected to leveler 100. Leveler 100 contains preferably 17 level rollers 102 which produce a uniform and smooth tin coating on stainless steel strip 12. After stainless steel strip 12 exits leveler 100, stainless steel strip 12 is cut by shear 104 into the desired strip lengths. Once the stainless steel strip 12 has been cut into tin coated stainless steel sheets 130, the sheets may be coated with a preweather agent 112. The tin coated stainless steel sheets 130 are preferably pre-weather coated by preweather coaters 114 which apply a pre-weather agent 112. Pre-weather agent 112 generally consists of a asphalt-base paint which is applied at a thickness of approximately 1–2 mils. Preferably, tin coated stainless steel sheets 130 are coated with a pre-weather agent 112 on both surfaces of tin coated stainless steel sheet 130. The pre-weather coaters 114 have the pre-weather agent 112 applied either by pre-weather sprayer 116 or by rotating the coaters 114 in pre-weather reservoir 110. The pre-weather agent 112 can be rapidly dried by heat lamp 120 and/or by a dryer 122. Tin coated stainless steel sheets 130 are pre-formed into highly corrosive-resistant roofing materials. Waterproof seams can be formed by folding the edges of two sheets together. The seals may also be soldered together with a tin solder. Solders containing lead do not not form as quality a solder as tin solders.

The invention has been described with reference to a preferred embodiment and alternates thereof. It is believed that many modifications and alterations to the embodiment discussed herein will readily suggest themselves to those skilled in the art upon reading and understanding the detailed description of the invention. It is intended to include all such modifications and alterations in so far as they come within the scope of the present invention.

We claim:

1. A weather resistant stainless steel strip comprising a strip of stainless steel having a thickness up to 0.2 inch and a coating of tin up to 0.05 inch thick, said coating applied to said strip by the process of continuously moving said strip through:

(a) an oxide removal procedure for removing oxides from said strip surface to provide very low level oxides on said strip surface, said oxide removal procedure includes aggressively pickling said strip surface with a solution of 5–25% hydrochloric acid and 1–15% nitric acid at a temperature of between 80°–140° C. for at least 10 seconds, then chemically activating said strip surface and maintaining a low-oxygen environment about said strip surface during said oxide removal, said aggressively pickling includes subjecting said stainless steel strip to a bath of pickling solution containing hydrochloric acid and nitric acid to said strip surface, said chemical activating includes subjecting said strip to a bath of deoxidizing solution containing zinc chloride; and (b) a bath of molten tin having a temperature of at least 449° F. and a lead content of less than 0.02 weight percent lead.

2. A stainless steel strip as defined in claim 1, wherein said tin coating thickness is at least 0.0003 inch.

3. A stainless steel strip as defined in claim 2, wherein said tin coating thickness is 0.001 to 0.002 inch.

4. A stainless steel strip as defined in claim 1, wherein said strip having a speed of 50–115 ft/min.

5. A stainless steel strip as defined in claim 1, wherein said strip surface is subjected to aggressively pickling for less than one minute.

6. A stainless steel strip as defined in claims 1, wherein said deoxidizing solution includes hydrochloric acid.

7. A weather resistant stainless steel strip comprising a strip of stainless steel having a thickness up to 0.2 inch and a coating of tin up to 0.05 inch thick, said coating applied to said strip by the process of continuously moving said strip through:

(a) an oxide removal procedure for removing oxides from said strip surface, said oxide removal procedure includes aggressively pickling said strip surface then chemically activating said strip surface and maintaining a low-oxygen environment about said strip surface during said oxide removal, said aggressively pickling includes subjecting said stainless steel strip to a bath of pickling solution containing hydrochloric acid and nitric acid to said strip surface, said chemical activating includes subjecting said strip to a bath of deoxidizing solution containing zinc chloride;

(b) a bath of molten tin having a temperature of at least 449° F. and a lead content of less than 0.02 weight percent lead; and (c) said tin coating is coated with an asphalt based paint.

* * * * *

Disclaimer 5,395,702 - Jay F. Carey, II, Follansbee, W. Va.; Mehrooz Zamanzadeh, Pittsburgh, Pa. COATED METAL STRIP. Patent dated March 7, 1995. Disclaimer filed October 26, 1998, by the assignee, The Louis Berkman Company.

The term of this patent shall not extend beyond the expiration date of Pat. No. 5,314,758.

*(Official Gazette,* June 1, 1999)

Disclaimer 5,395,702 — Jay F. Carey, II, Follansbee, W. VA. COATED METAL STRIP. Patent dated March 7, 1995. Disclaimer filed May 31, 2002, by the assignee, The Louis Berkman Company.

The term of this patent shall not extend beyond the expiration date of Pat. No. 5,354,624.

*(Official Gazette, April 22, 2003)*

UNITED STATES PATENT AND TRADEMARK OFFICE

CERTIFICATE OF CORRECTION

PATENT NO. : 5,395,702
DATED : March 7, 1995
INVENTOR(S) : Carey, II et al.

It is certified that error appears in the above-identified patent and that said Letters Patent is hereby corrected as shown below:

Title page,
Delete Item [63] and substitute therefor the following:

-- Continuation of Ser. No. 08/000,010, Jan. 4, 1993, abandoned, which is a continuation-in-part of Ser. No. 07/858,662, Mar. 27, 1992, Pat. No. 5,314,758.

Continuation of Ser. No. 08/000,010, Jan. 4, 1993, abandoned, which is a continuation-in-part of Ser. No. 07/858,662, Jul, 15, 1992, Mar. 27, 1992, Pat. No. 5,314,758. --

Column 1,
Line 9, after "5,314,758." add the following:
-- This application is also a Continuation of U.S. patent application Ser. No. 08/000,010, filed Jan. 4, 1993, now abandoned, which in turn is a continuation-in-part of U.S. patent application Ser. No. 07/913,209, filed July, 15, 1992, now abandoned, which in turn is a continuation-in-part of U.S. patent application Ser. No. 07/858,662, filed March 27, 1992, now U.S. Patent No. 5,314,758. --

Signed and Sealed this

Fourteenth Day of October, 2003

JAMES E. ROGAN
*Director of the United States Patent and Trademark Office*